United States Patent [19]

Robitaille

[11] Patent Number: 4,754,285

[45] Date of Patent: Jun. 28, 1988

[54] EXPANSION BAND ANTENNA FOR A WRISTWATCH APPLICATION

[75] Inventor: Michael A. Robitaille, Bloomfield, Conn.

[73] Assignee: Timex Corporation, Middlebury, Conn.

[21] Appl. No.: 44,634

[22] Filed: May 1, 1987

[51] Int. Cl.[4] ..... H01Q 1/12

[52] U.S. Cl. ..... 343/718; 343/868

[58] Field of Search ..... 343/718, 723, 868

[56] References Cited

U.S. PATENT DOCUMENTS 3,582,951 6/1971 Altmayer ..... 343/718

3,902,118 8/1975 Ikrath et al. ..... 343/718

FOREIGN PATENT DOCUMENTS 0100639 2/1984 European Pat. Off. ..... 343/718

*Primary Examiner*—William L. Sikes

*Assistant Examiner*—Robert E. Wise

*Attorney, Agent, or Firm*—William C. Crutcher

[57] ABSTRACT

An antenna for a radio frequency transmitter or receiver carried in a wrist instrument is made as a loop of individually insulated multistrand wire embedded in an elastic fabric which comprises an expansion wristband for the wrist instrument, together with a capacitor embedded in a strap end. The multistrand wire is longer than the unstretched fabric and is either interwoven into the elastic field or sandwiched between two layers of fabric. The wire is folded back and forth in a serpentine shape in order to accomodate expansion. One end of the multistrand wire is soldered to a ground connection clip and the connection is embedded in a molded strap end. The other end of the multistrand wire is soldered to an insulated wire leading into the instrument case and to one lead of a capacitor. The other lead of the capacitor is soldered to a ground connection clip and all connections, as well as the capacitor are embedded in the other molded strap end.

10 Claims, 3 Drawing Sheets

EXPANSION BAND ANTENNA FOR A WRISTWATCH APPLICATION

BACKGROUND OF THE INVENTION

This invention relates to an antenna construction for a radio transmitter or receiver to be carried on the wrist, and more particularly relates to an expansion band antenna for a wristwatch radio device.

Several proposals are known for antennas for small portable radios in which the antenna is incorporated into a belt or strap which also supports the radio on the person of the user. Examples of these are shown in U.S. Pat. No. 2,470,687 issued to Cafrella et al. on May 17, 1949, U.S. Pat. No. 3,523,296 issued to Vliegenthardt on Aug. 4, 1970, U.S. Pat. No. 2,255,897 to Rebori et al. on Sept. 16, 1941, and U.S. Pat. No. 4,340,972 issued to Heist on July 20, 1982. The Heist and Vliegenthardt patents depict antennas designed to function as conventional dipoles. The Cafrella et al. patent shows a loop antenna stitched between two plies of a supporting belt, and the Rebori patent depicts a loop antenna with a parallel connected tuning capacitor and coupled to a crystal "detector".

Proposals are also known for combining a radio transmitter or receiver with a timepiece and arranging the antenna for the transmitter or receiver inside two separate halves of a wristband, the conductors in each half being connected to the radio device inside the timepiece case. An example is shown in U.S. Pat. No. 3,032,651 to Gisiger-Stahli et al. on May 1, 1962 having serpentine conductors folded back and forth longitudinally along the halves. Another proposal appears in published European patent application No. 0 100 639 A2 published Feb. 15, 1984 in the name of Sinclair Research Limited. A continuous watchband is shown with transversely oriented loops strung on a pair of conductors running longitudinally and embedded in the watchband, the separate loops being wound on ferrite cores.

A proposal for a wristwatch receiver antenna is disclosed in PCT application, International Publication No. WO 86/03645 published June 19, 1986 in the name of AT&E Corporation, in which the watchband comprises two sections of a strip conductor within a strap fastened by a conductive clasp or buckle. This construction requires special grommets on one side to make connection with the tongue of the buckle on the other side or use of a conductive clasp. Such proposals introduce the possibility of electrical discontinuities the midpoint of the antenna. An alternate proposal in the aforesaid application was to zig-zag a conductor through successive links of a metal expansion band. The AT&E construction attaches the strap or band ends to conventional spring bars which also are electrically connected to the antenna ends. One spring bar makes electrical connection to the case through spring contact. The other spring bar makes spring contact with inner cylindrical members which are connected to the radio receiver. Outer cylindrical members serve as capacitors with the inner cylindrical members to tune the antenna. The use of several pressure or spring loaded connections create electrical discontinuities which can be a source of noise.

Normally an antenna is designed with regard to the wavelength at which it is to be operated. However, a wristwatch antenna is obliged to transfer energy within the constraints of the physical size of the wrist instrument. The theory of small antennas is set forth in *Small Antennas* by Harold A. Wheeler published in IEEE Transactions and Antennas and Propogation, volume AP-23, No. 4, July 1975 and also in an article entitled "Loop Antennas" by Glenn S. Smith, pages 5-2 through 5-9 appearing in *Antenna Engineering Handbook,* Second Edition, published by McGraw Hill, 1984. As the antenna is made smaller, the most important effect on its performance is the decrease in its radiation resistance, a measure of the amount of energy transmitted by an antenna, which in turn decrease its efficiency: therefore, an antenna for a wrist instrument must be made as large as possible. The greatest physical dimension of a member which is available as the antenna for a wrist instrument is the circumference of the wrist, which is typically around 20 cm. For a resonant loop antenna, the circumference of the loop is equal to half a wavelength. This implies that a loop around the wrist would be resonant at approximately 750 MHz. If the wrist loop antenna is operated at frequencies below half its self resonant frequency, the radiation resistance can range from microohms to a few ohms for frequencies ranging from 40 to 500 MHz. Since the efficiency of the antenna is a transmitter is the ratio of the radiation resistance to the total resistance of the antenna, the total resistance must be kept low. The total resistance includes the resistance of the conductor, contact points and the grounding system.

When designing the antenna for a receiver, one of the most important factors that must be considered, is its effect on the range of the instrument. The range of any receiver is greatly affected by the amount of electrical noise it adds to the incoming signal. Non-permanent connections, such as screwed-down connections or other types of pressure contact points which are not permanently soldered in place are such a source of electrical noise.

One of the requirements for a wrist instrument is to be able to get the instrument off and on the wrist. This either requires a buckle or clasp, or an expansion band. An expansion band will permit an antenna construction with a single conductor without electrical discontinuities which might degrade its performance as an antenna and does not require that a buckle or clasp be reconnected if the instrument is to be operated after it has been removed from the wrist. However, an expansion band must be flexible and able to expand and contract without affecting the performance of the small antenna associated with it.

Accordingly, one object of the present invention is to provide an improved expansion band antenna for a wristwatch transmitter/receiver.

Another object of the invention is to provide an improved loop antenna for a wrist instrument which efficiently operates as a tuned circuit for radio frequency transmission or reception.

Another object of the invention is to provide an improved antenna for a wrist instrument with a minimum number of pressure contacts or spring loaded electrical connections.

SUMMARY OF THE INVENTION

Briefly stated, the invention comprises an expansion band antenna for attachment to a wrist instrument comprising a continuous wire member embedded in a strap member of elastic fabric making up the expansion band. The wire length is greater than the unstretched strap length and is folded back and forth across the width of the unstretched strap to accommodate expansion. It may be either interwoven into the elastic fabric or sandwiched between two layers or plies of fabric. Preferably, the wire member comprises individually insulated strands in a multistrand copper wire, one end connected to ground on the watchcase, the other end connected to the radio device and also connected to the watchcase ground via a capacitor which is embedded in a molded strap end. The capacitor is chosen to tune the antenna to a preselected frequency. All antenna electrical connections are soldered and embedded in the strap ends, with the exception of two screwed connections to the watch case.

DRAWING

Other objects and advantages of the invention will be more clearly understood by reference to the following description taken in connection with the accompanying drawing, in which:

FIG. 1 is an exploded perspective view of the components of the wristband antenna and wrist instrument, FIG. 2 is a perspective assembly drawing showing a back view of the wrist instrument and expansion band, FIG. 3 is an electrical circuit diagram of the antenna, FIG. 4 is a perspective view of one molded strap end, FIG. 5 is a perspective view of the other strap end, and FIG. 6 is a simplified schematic top plan view of a modified form of the expansion strap.

DESCRIPTION OF THE PREFERRED EMBODIMENT

Figure 1:
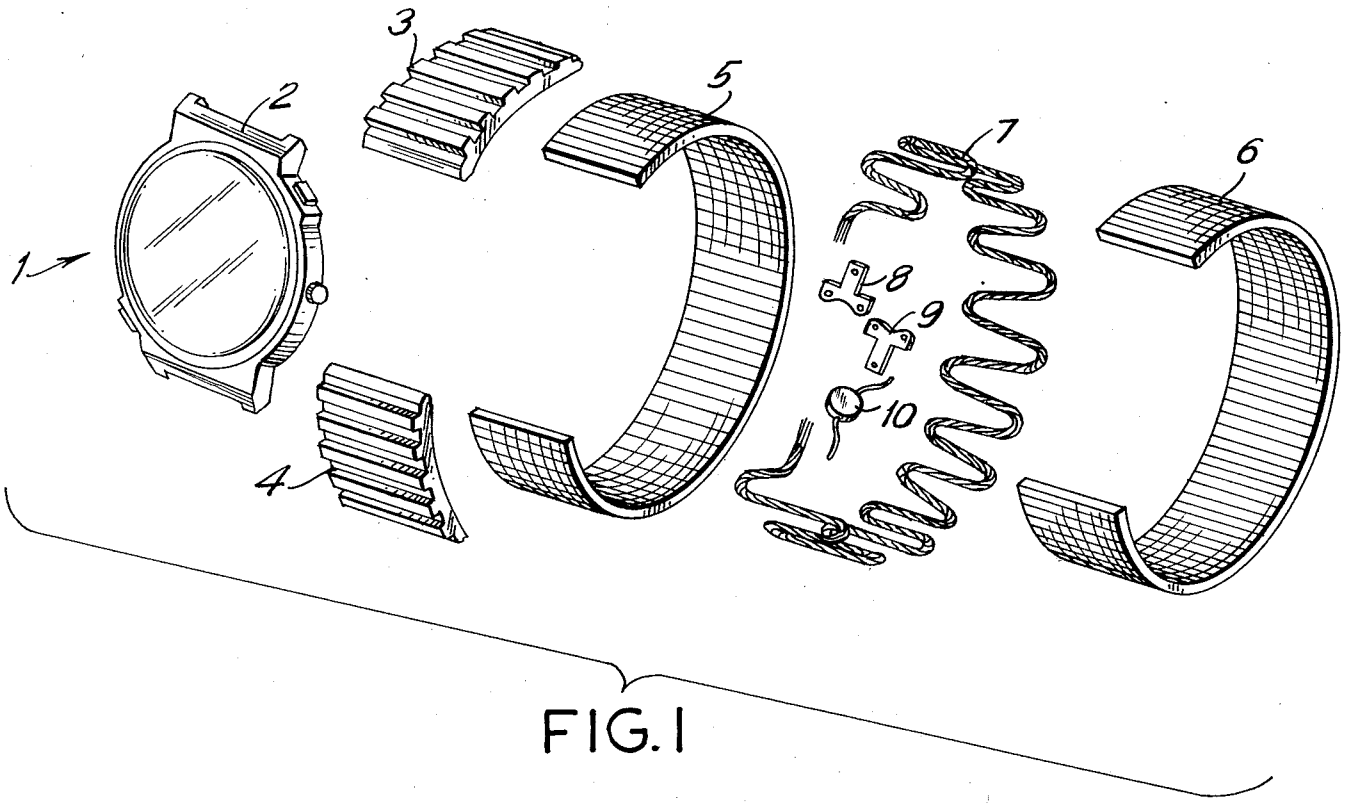

Referring now to FIG. 1 of the drawing, the exploded perspective view illustrates component parts of a preferred form of the invention. Shown generally at 1 is a wrist instrument in the form of a wristwatch having, in addition to the usual timekeeping elements, a radio receiver and/or transmitter (not shown) for sending and/or receiving radio frequency signals to and from the wrist instrument. By way of example, and not intended to be limiting in the invention claimed, the present application contemplates an FM radio transmitter operating at a frequency of approximately 40 MHz and transmitting a coded signal by modulating the carrier wave with frequency shift keying in accordance with a prescribed protocol in order to actuate an emergency or security device at some distance from the wrist instrument. The invention is equally applicable to a radio receiver, such as found in paging devices, hence the term radio device is used herein to apply either to a receiver, a transmitter, or a transceiver.

The invention is also applicable to antennas for use over a frequency spectrum generally covering the HF and VHF bands, ranging from 3 to 750 MHz, having respective wave lengths of 100 to 0.4 m. Wrist instrument 1 includes a metal case 2 acting as a ground connection and is arranged to be attached on either side to molded strap ends 3, 4 by screw connections to first and second metal ground connection clips 8 and 9, having portions which are embedded in first and second strap ends 3 and 4, respectively.

In accordance with one aspect of the present invention, the expansion band antenna employs an elastic fabric strap member shown in FIG. 1 as consisting of inner and outer plies 5 and 6 which are sewn together, although a single sleeve of elastic fabric may be provided in lieu of two separate pieces. Interposed between plies 5 and 6 is a continuous length of multistrand antenna wire 7. The length of wire member 7 is longer than that of the unstretched strap member and is formed in a serpentine, sinusoidal, or zigzag shape such that the wire is folded back and forth transversely across the width of the strap member plies 5, 6. The ends of the wire member terminate at the respective ends of the strap member. The extended length of the serpentine antenna wire 7 is such that when the elastic fabric is stretched, it will flex and extend longitudinally along with the elastic fabric so that the band will pass over the hand of the wearer of the wrist instrument without damaging or breaking the wire.

Although the serpentine antenna wire could be a single solid conductor, it has been found that preferred electromagnetic characteristics, as well as increased wire flexibility and high reliability are achieved by utilizing a multistrand wire of individually insulated copper strands. The optimum number of strands depends upon the desired flexibility frequency and reliability and is also determined by the shape and pitch of the serpentine folds. Satisfactory results have been achieved both with 16 strands of 28 gauge wire and with 150 strands of 38 gauge wire. However, depending upon the frequency of the signal and the other factors enumerated above, the wrist antenna wire is useful over a range from around 2 strands to as many as 200 strands of wire. As is known in the art, high frequency A-C current flows on the outer surface of the strands due to "skin effect." Therefore, increasing the number of strands for the same copper cross sectional area increases the "skin" surface area and hence lowers the resistance to current flow which is in phase with emf. The described antenna is largely inductive. Stranding the antenna wire adds capacitance, and reduces the external capacitance needed to tune the antenna.

Ground connection clips 8, 9 and a capacitor 10 are used to make the necessary connections between the ends of the antenna wire and the wrist instrument 1.

Figure 2:
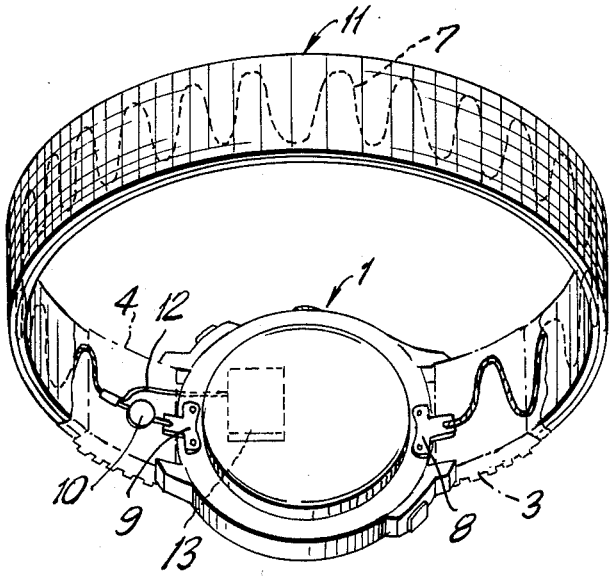

Referring to FIG. 2 of the drawing, wrist instrument 1 is shown from the back attached to an assembled expansion band antenna shown generally as 11. One end of the antenna wire 7 is connected with screws to ground on the back of the watchcase using ground connection clip 8. The other end of antenna wire 7 branches. One branch is connected to capacitor 10 which, in turn, is connected to the wrist instrument case by ground connection clip 9. The other branch, indicated at 12 is the signal lead and is insulated and conducted to the interior of the wrist instrument, where it is attached to the signal output of a radio device, here a transmitter 13.

Figure 3:
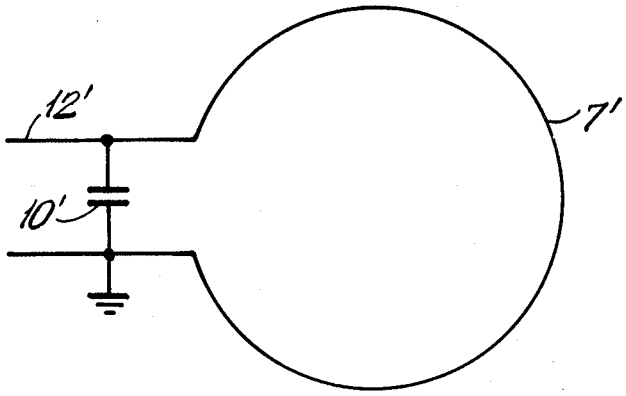

Reference to FIG. 3 shows the electrical schematic diagram, wherein 7' is the antenna wire, 10' is the parallel-connected capacitance of capacitor 10 and 12' is the signal lead from the radio device. The antenna acts as an electrically small loop and must be tuned to become a parallel resonant circuit by proper selection of capacitor 10 in order to match the inductive properties of the stranded antenna loop.

Figure 4:
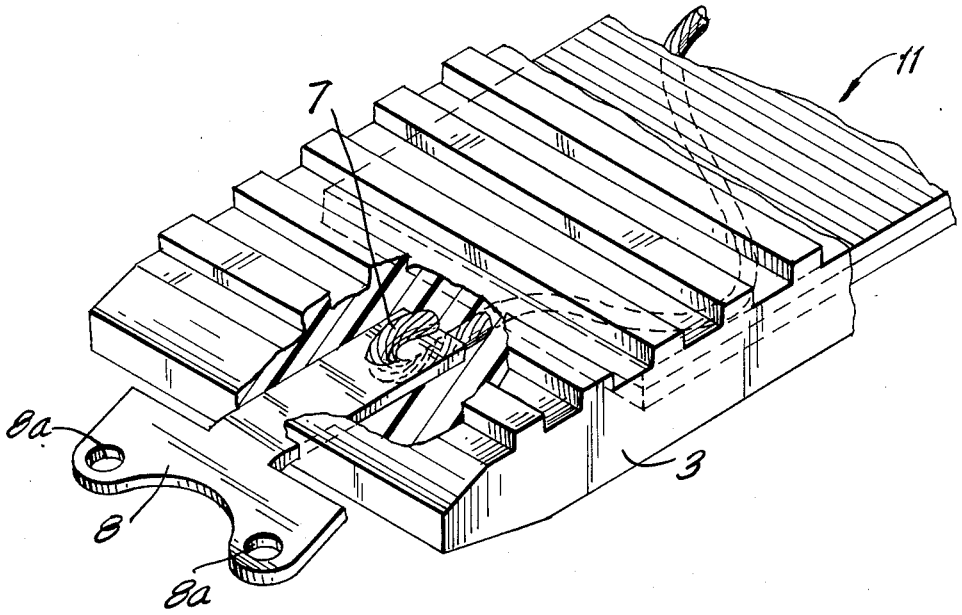

FIG. 4 is an enlarged perspective view of strap end 3. The multistrand antenna wire 7 is connected to ground connection clip 8 and securely soldered. Then the end of the expansion strap 11 and a projecting portion of the clip 8 are placed in a mold and a suitable insulating plastic material is injected and molded around the strap and clip. The clip includes screw holes **8*a*** which are used to attach the clip to the watch case.

Figure 5:
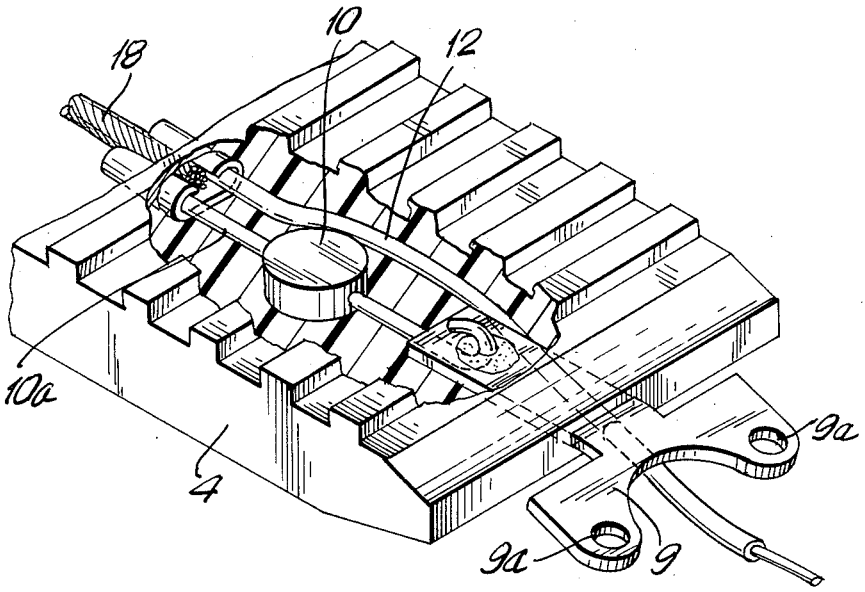

FIG. 5 shows the other strap end 4 to be similarly constructed, except that a capacitor is also molded in the strap end. A soldered branch connection is made using clip 18 to attach the end of the multistrand antenna wire 7 to one lead 10*a* of capacitor 10, and to insulated lead-in wire 12. The other lead 10*b* of the capacitor is soldered to clip 9. The aforesaid elements are all overmolded and embedded in the plastic strap end 4. Holes 9*a* in the clip 9 are used to screw the strap end to the watch case, while lead 12 is connected internally to the radio device 13 inside the case.

By way of example, very good results were obtained with 150 strands of 38 AWG gauge wire with an extended length of 10 inches serpentined to a length of 6.5 inches (unstretched strap length) and adding a capacitor of approximately 100 pf. The antenna impedance (on the wrist) of the tuned circuit at 40 MHz was 4,500 ohms at $-2°$ phase angle (capacitive) using a standard transmitter with unbalanced output and a tuning circuit which matched the antenna to 50 ohms yielded 69 dbuv per meter at 3 meters with approximately 8 mWatts of power in.

Figure 6:
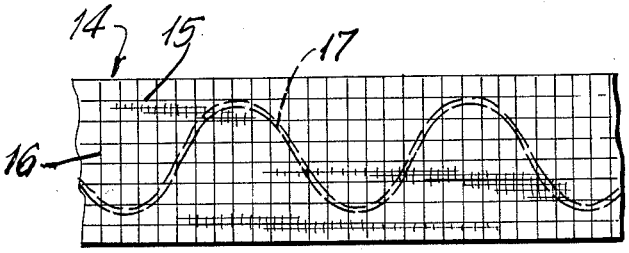

Referring to FIG. 6 of the drawing, a modified form of the expansion band antenna consists of a single ply of woven fabric 14 comprising interwoven elastic longitudinal strands 15 and transverse strands 16. Interwoven among the strands 15, 16 is a serpentine multistrand antenna wire 17. This type of construction may be preferable for automated production of expansion band antenna strap in great quantity, which is then cut to proper length and assembled in the manner previously described.

It remains to note that the types of terminating clips and added capacitance shown are purely exemplary and may exhibit many forms to suit the method of attachment to the wrist instrument. They are preferably molded into the strap ends 3, 4 in order to hold the strands in place without damage and to provide sturdy end connections. A special type of molded strap end with embedded capacitive plates could be substituted for the discrete capacitor 10.

A high level of efficiency of the disclosed expansion band antenna is attained by the disclosed construction, for the following reasons. The loop antenna minimizes electrical discontinuities which can increase contact resistance and degrade performance. The use of multistrand wire decreases the conductor resistance due to skin effect. Placing the resonating capacitor into the strap end and soldering it to the conductors reduces contact resistance and improves performance.

While there has been described what is considered to be the preferred embodiment of the invention, it is desired to cover in the appended claims all such modifications as fall within the true spirit and scope of the invention.

I claim:

1. An expansion band antenna for a wrist instrument having a case providing a ground connection, said wrist instrument incorporating a radio device therein operating within a preselected frequency band, comprising:

an elastic strap member adapted to hold to said wrist instrument in place and stretchable to pass over the hand of a wearer, a continuous wire member having an extended length greater than that of said strap member, said wire member being folded back and forth across the width of the strap member and disposed within the strap member, and having opposite ends of the wire member terminating at opposite respective ends of the strap member, and first and second insulating strap ends attached to said strap member, first and second ground connection clips adapted for electrical connection to said case and having portions embedded in said first and second strap ends respectively, means embedded in said first strap end electrically connecting one end of the wire member to said first ground connection clip, and an insulated lead electrically connected at one end to said radio device and having its other end embedded in said second strap end and connected to said wire member.

2. The expansion band antenna in accordance with claim 1 and further including a capacitor embedded in said second strap end and electrically connected between said wire member and said second ground connection clip, said capacitor being selected to tune said antenna to resonance within said preselected frequency band.

3. The combination according to claim 2 wherein said frequency band includes 40 MHz, wherein said wire member comprises a multistrand wire of between 2 and 200 individually insulated strands, and wherein said capacitor is of a capacitance between 100 and 120 pf.

4. The combination according to claim 2 wherein said strap ends comprise plastic insulating material molded around said ground connection clips, capacitor and wire member ends to hold them in place.

5. The expansion band antenna in accordance with claim 1, wherein said wire member comprises a multistrand wire of individually insulated strands.

6. The combination according to claim 5 wherein the number of strands lies within a range of 2 to 200.

7. The expansion band antenna according to claim 1, wherein said strap member comprises inner and outer plies of woven elastic fabric material having said wire member disposed between said plies.

8. The expansion band antenna according to claim 1, wherein said strap member comprises a sleeve of woven elastic fabric material having said wire member disposed inside said sleeve.

9. The expansion band antenna according to claim 1, wherein said strap member comprises a woven elastic fabric material of longitudinal and transverse strands, and having said wire member interwoven among said strands.

10. An expansion band antenna for a wrist instrument having a case providing a ground connection and having a radio device incorporated therein, said radio device operating at a preselected frequency, comprising:

an elastic strap member adapted to hold said wrist instrument in place and stretchable to pass over the hand of a wearer, a continuous multistrand wire member of individually insulated strands selected from a number on the order of 2 to 200 strands and having an extended length greater than that of said strap member, said wire member being folded back and forth in serpentine shape across the width of the strap member and carried within the strap member and having opposite ends of the wire member terminating at opposite ends of the strap member, a pair of ground connection clips adapted for attachment to said case, a capacitor selected to tune the antenna to resonance at said preselected frequency, first and second molded plastic insulated strap ends attached to opposite ends of said strap member, first means connecting one end of said wire member to one of said ground connection clips, and second means connecting the other end of said wire member both to said radio device lead and to one said of said capacitor, and further connecting the other side of said capacitor to the other of said ground connection clips, and wherein said capacitor and said first and second connecting means are attached using soldered connections and are embedded in said first and second strap ends, whereby electrical noise and contact resistance due to each connection is minimized.

* * * * *